United States Patent [19]

Gardner

[11] 4,127,304

[45] Nov. 28, 1978

[54] SELF ERECTING PARTITION

[75] Inventor: Jeffrey M. Gardner, Wheaton, Ill.

[73] Assignee: Container Corporation of America, Chicago, Ill.

[21] Appl. No.: 869,422

[22] Filed: Jan. 16, 1978

[51] Int. Cl.[2] ..... B65D 5/48

[52] U.S. Cl. ..... 229/15; 229/27; 229/42

[58] Field of Search ..... 206/186; 229/27, 29 E, 229/15, 42

[56] References Cited

U.S. PATENT DOCUMENTS

| | | | |
|---|---|---|---|
| 3,248,036 | 4/1966 | Weiss | 229/15 |
| 3,400,876 | 9/1968 | Wainberg | 229/42 |
| 3,738,561 | 6/1973 | Nederveld | 229/15 |
| 4,030,660 | 6/1977 | Rada et al. | 229/42 |

FOREIGN PATENT DOCUMENTS

| | | | |
|---|---|---|---|
| 882,716 | 11/1961 | United Kingdom | 229/42 |

*Primary Examiner*—William Price
*Assistant Examiner*—Bruce H. Bernstein
*Attorney, Agent, or Firm*—Carpenter & Ostis

[57] ABSTRACT

A self erecting interior partition structure formed of a unitary blank of foldable paperboard adapted to form two adjacent cells.

1 Claim, 6 Drawing Figures

SELF ERECTING PARTITION

BACKGROUND OF THE INVENTION

This invention relates to internal dividers or partitions adapted to form separate cells within an outer enclosure or container. It is an object of the invention to provide a self erecting paperboard partition in which certain panels of the partition automatically move into position as two center panels of the partition forming blank are folded in face-to-face relation about a common fold line. These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 3:
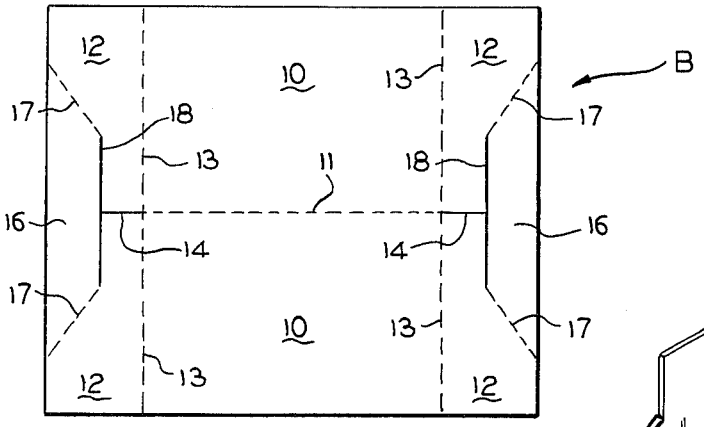
FIG. 3 is a plan view of a blank of foldable sheet material from which the partition structure of the other views may be formed.
Figure 1:
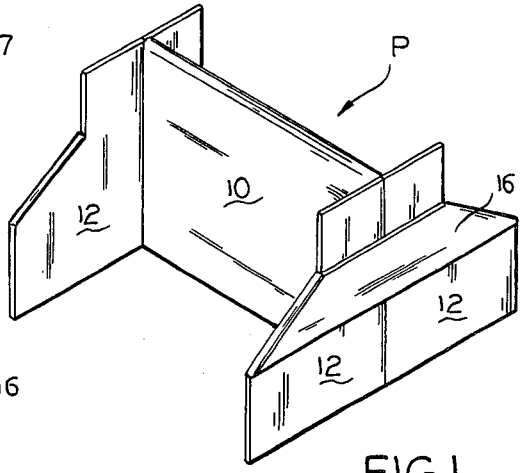
FIG. 1 is a perspective view of a partition structure embodying features of the invention as shown in the erected condition.
Figure 2:
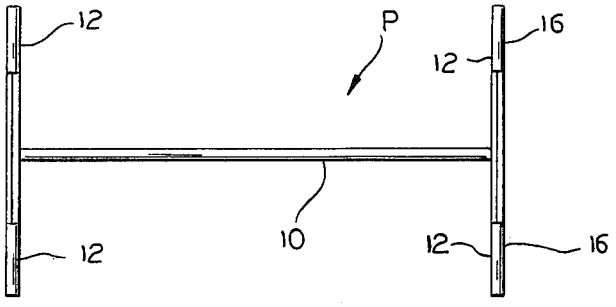
FIG. 2 is a plan view of the structure illustrated in FIG. 1.

Referring now to the drawings for a better understanding of the invention, it will be seen that the novel partition P illustrated in FIGS. 1 and 2 may be formed from a unitary blank B of foldable sheet material such as paperboard, which is illustrated in FIG. 3.

As best seen in FIG. 1, the partition P includes a pair of vertically disposed center panels 10 which are folded in face-to-face relation with their upper edges being joined to each other about a common fold line 11.

At each end of the partition structure, there is provided a pair of end panels 12 which are foldably joined at their inboard edges along fold lines 13 to the adjacent end edges of the respective center panels 10.

The end panels 12 of each pair are separated from each other by a cut line 14 but are joined to each other by a relatively narrow strap or connecting panel 16.

Connecting panel 16 is foldably joined at opposite ends thereof to inclined outboard edges of the respective end panels 12 along downwardly diverging fold lines 17. Connecting panel 16 is also separated from portions of respective end panels 12 by a cut line 18 which extends between the inner extremities of fold lines 17.

In erecting the partition structure, as the center panels 10 are folded in face-to-face relation about fold line 11, the remaining end panels, which are four in number, will all automatically be moved into the erected position shown in FIG. 1 by virtue of the connecting panel 16 which serves to position the end panels relative to the center panels. Connecting panel 16 also affords additional rigidity for the partition structure. It will be noted that in the embodiment of the invention illustrated in FIGS. 1 through 3, there are formed two cells of equal size and shape.

Figure 6:
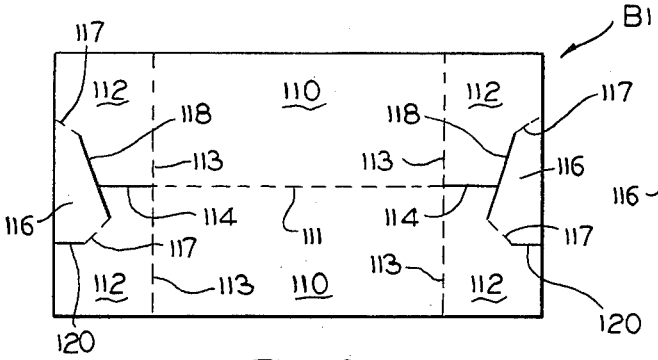
FIGS. 4 through 6 are views similar to those of FIGS. 1 through 3, but illustrating a modified form of the invention.
Figure 4:
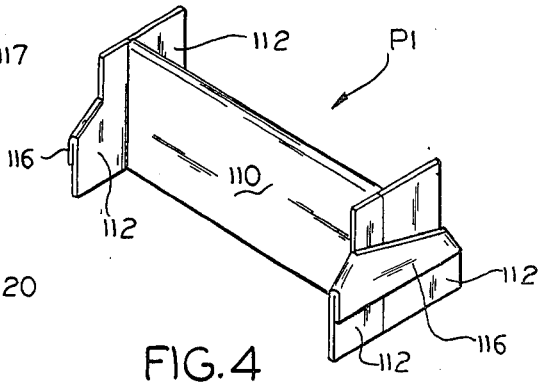
Figure 5:
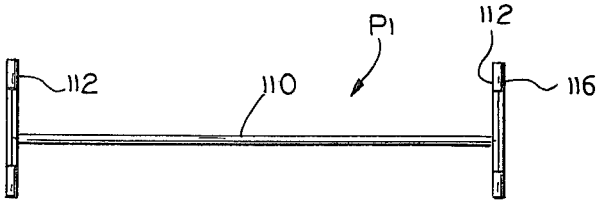

Turning now to FIGS. 4 through 6, it will be seen that another embodiment of the invention is shown which is similar to the previously described embodiment except that the two cells formed thereby are of unequal size.

The structure is quite similar to that of the previously described embodiment and related numerals have been used to designate those portions of the structure which correspond to similar portions of the structure of the previous embodiment. The only substantial difference between the two embodiments is in the arrangement of the connecting panel 116. Each connecting panel 116 is foldably joined to related end panels 112 along downwardly diverging fold lines 117, and connecting panel 116 is separated from related end panels 112 by a cut line 118. In order to achieve a structure wherein the cells formed are of different size, the connecting panel arrangement is not symmetric as it is in the previously described embodiment. In the present embodiment there is also provided a cut line 120 which extends from the lower end of one of the cut lines 117 to the adjacent edge of the blank. The operation and function of this embodiment is similar to that of the previous embodiment in every respect except for the fact that the cells formed are of unequal size.

I claim:

1. A self-erecting internal partition structure comprising:

(a) a pair of vertically disposed center panels positioned in face-to-face relation and having upper edges foldably joined to each other about a horizontal hinge line;

(b) a pair of vertical end panels at each end of said center panels;

(c) said end panels of each pair being free from direct attachment to each other but being aligned with each other in a common vertical plane extending normal to said center panels, and each end panel having an inboard edge foldably joined to an adjacent end edge of a related center panel;

(d) a relatively narrow connecting panel positioned at each end of said partition and extending across outer faces of both adjacent end panels;

(e) each of said connecting panels being foldably joined at opposite ends to outboard edges of respective end panels along diverging fold lines and being disposed to lie against outer faces of said end panels to provide additional rigidity for said partition structure, to cause said end panels to automatically move to erected position when said center panels are folded in face-to-face relation, and to prevent said center and adjacent end panels from moving away from each other about said hinge line.

* * * * *